United States Patent [19]

Treder

[11] 4,015,777

[45] Apr. 5, 1977

[54] THERMOSTATIC EXPANSION VALVE CAPSULE

[75] Inventor: Charles F. Treder, Brookfield, Wis.

[73] Assignee: The Singer Company, New York, N.Y.

[22] Filed: Feb. 5, 1976

[21] Appl. No.: 655,491

[52] U.S. Cl. ..... 236/92 B; 62/225; 137/312

[51] Int. Cl.[2] ..... G05D 23/02

[58] Field of Search ..... 236/99 D, 92 B; 62/217, 62/224, 225, 528; 137/312

[56] References Cited

UNITED STATES PATENTS

| | | | |
|---|---|---|---|
| 1,721,204 | 7/1929 | Burstall | 251/63.4 |
| 2,386,067 | 10/1945 | Schlenker | 137/312 X |
| 3,076,474 | 2/1963 | Skomp | 137/312 X |
| 3,525,234 | 8/1970 | Widdowson | 62/217 |
| 3,707,984 | 1/1973 | Bantz | 137/312 |
| 3,713,458 | 1/1973 | Lee | 137/312 |

*Primary Examiner*—William E. Wayner
*Assistant Examiner*—William E. Tapolcai, Jr.
*Attorney, Agent, or Firm*—Michael, Best & Friedrich

[57] ABSTRACT

The thermostatic expansion valve capsule is shown mounted in a cavity in a receiver of a widely used device. The exterior of the valve body utilizes two or three O-ring seals to achieve the proper connections in the installation. The temperature responsive charge in the head chamber above the diaphragm controls the movement of the valve in accordance with the temperature of the returning refrigerant, liquid or vapor, coming from the evaporator in an automotive air conditioning system. It is necessary to keep control in accordance with that temperature and, therefore, the temperature of the refrigerant leaving the expansion valve must not influence the head chamber temperature. Thermal conduction between the valve portion and the head portion of the valve body is minimized by undercutting the valve body and flow of refrigerant from the higher pressure in the outlet of the valve to the lower pressure under the diaphragm is minimized by providing a deliberate bleed or bypass so the very cold refrigerant cannot reach the chamber under the diaphragm. In the three O-ring version this communicates with the undercut which, in turn, vents to the suction throttling valve outlet pressure through a conduit in the receiver body. In the two O-ring version that conduit is plugged and the upper O-ring is omitted so the undercut is at the same pressure as the space outside the diaphragm head chamber which is evaporator outlet pressure.

6 Claims, 2 Drawing Figures

THERMOSTATIC EXPANSION VALVE CAPSULE

BACKGROUND OF THE INVENTION

Widdowson U.S. Pat. No. 3,525,234 shows a receiver containing a thermostatic expansion valve and a suction throttling valve, each of the valves being in integral subassembly form and mountable in the receiver. This patent is assigned to General Motors Corporation and, not surprisingly, is used extensively in General Motors Corporation air-conditioned automobiles.

The thermostatic expansion valve capsule shown in the Widdowson patent provides an O-ring seal preventing axial flow along the operating pin of the expansion valve, thus keeping the very cold refrigerant from the underside of the diaphragm where it could, in effect, take away control from the head chamber above the diaphragm. The patent expansion valve is somewhat costly to manufacture.

SUMMARY OF THE INVENTION

The object of this invention is to provide a thermostatic expansion valve capsule for use in the receiver shown in U.S. Pat. No. 3,525,234.

The present valve is less complicated than that employed in the patent and yet can perform the same functions. The valve is adaptable to use in a flooded-type refrigeration system or in a conventional system.

The use of a bleed from the actuating pin to an undercut space in the valve body to prevent flow of refrigerant to the underside of the diaphragm where it would take away control is thought to be novel. The seal required in the aforesaid patent is not required in this design. The undercut valve body also functions to reduce heat conduction through the body to the diaphragm chamber.

DESCRIPTION OF THE PREFERRED EMBODIMENT

Figure 1:
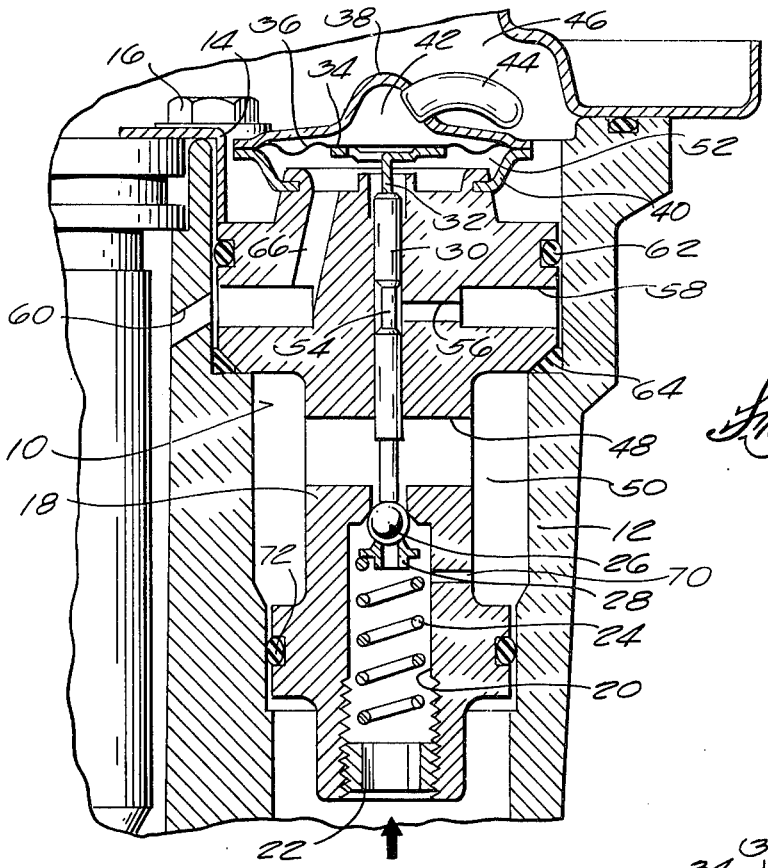
FIG. 1 is a vertical section through the present valve capsule mounted in the receiver with the receiver being shown only in part. This is the three-ring version utilized in conjunction with a flooded-type air conditioning system.

The thermostatic expansion valve capusle 10 is shown mounted in a cavity in the receiver or container 12 which is the standard General Motors container as depicted in U.S. Pat. No. 3,525,234. In order to mount this capsule in the cavity and adapt it to the General Motors unit the holddown bracket 14 is mounted by means of the screws 16 (the screws are part of the standard General Motors unit) so the depending portion of the bracket 14 acts on the upper surface of the valve body to hold the capsule in place. When so mounted the lower portion of the body 18 functions as the valve inlet. Thus conduit 20 is the inlet to the valve capsule. The threaded spring seat 22 determines the preload of spring 24 and urges the ball-type valve 26 supported by retainer 28 to its seat. The valve is actuated by the push pin 30, the upper end of which is engaged by the finger 32 depending from the pad 34 on the underside of diaphragm 36. The perimeter of the diaphragm 36 is captured between upper and lower head stampings 38, 40 which are welded together at their periphery. The space 42 above the diaphragm is charged with a refrigerant (preferably a refrigerant gas which is superheated at operating temperatures such as the refrigerant known as R500) through the charging capillary 44 which is then sealed. Chamber 42 is exposed to and senses the temperature of the refrigerant in space 46 which is in the evaporator outlet flow path and, therefore, is at evaporator outlet pressure and temperature.

Since the head chamber 42 is the temperature sensing chamber it is important that it not be exposed to temperature which would, in effect, take away control. When the valve 26 is open the refrigerant flow on the downstream side of the valve 26 is mostly liquid and is colder than the refrigerant leaving the evaporator. Thus the diaphragm chamber must be immunized against the influence of this lower temperature. The flow leaving the valve goes into the cross conduit 48 which leads to chamber 50 between the capsule body and the container cavity. This, through porting, leads to the evaporator inlet. This pressure is higher than the pressure leaving the evaporator outlet. Therefore, there is a tendency for refrigerant to flow along the clearance between the push pin and the valve body. In the Widdowson patent this flow is prevented from reaching the diaphragm chamber 52 on the underside of diaphragm 36 by means of an O-ring seal on the push pin. The need for the O-ring seal is eliminated in the present design by providing the undercut 54 on the push pin 30 and then porting through the valve body at that point by means of conduit 56 leading to undercut 58 in the valve body. This undercut, in turn, communicates in a flooded-type system through port 60 in the receiver or container body 12 with the suction throttling valve outlet. The undercut 58 is isolated from the evaporator outlet by O-ring 62 and from the evaporator inlet pressure by O-ring 64. The valve body is additionally provided with a conduit 66 leading from the diaphragm chamber 52 to undercut 58. This, then, eliminates any tendency for refrigerant to go from the higher pressure at the valve outlet to the diaphragm chamber. Any leakage along the push pin is bypassed away from the diaphragm chamber and, therefore, this cold refrigerant cannot reach the diaphragm chamber to take away control from head chamber 42.

The undercut 58 serves an additional function in that it reduces the metal area of the valve between the cold part of the valve represented by the lower portion and the warmer part of the valve which is the head chamber where you want to keep the control. By reducing the area thermal conductivity is accordingly reduced and the head chamber retains control as desired.

If the capsule is to be used in conjunction with a conventional air conditioning system (as opposed to the flooded-type system described above) the conduit 60 is provided with a plug 68 or in initial manufacture would not be provided in the first place. Then the same capsule is used but the upper O-ring 62 of FIG. 1 is omitted. This results in the pressure in undercut 58 being at evaporator outlet pressure and the pressure in the diaphragm chamber 52 is also at evaporator outlet pressure. Therefore, there is no pressure gradient from undercut 54 on the push pin 30 to the diaphragm chamber and, therefore, there will be no flow to the diaphragm chamber. Thus the head chamber 42 retains control.

In both versions there is a bypass 70 from the inlet directly to chamber 50 so that even when the valve 26 is closed there will be a limited supply of refrigerant to the evaporator. Thus the bypass gives a limited leak past O-ring 72 which blocks the lower part of the chamber from chamber 50 and the evaporator inlet.

In the flooded-type system illustrated in FIG. 1 the suction throttling valve utilized in the system according to Widdowson maintains evaporator pressure at 29 to 30 psig. With the evaporator pressure constant the returning refrigerant flow across the head chamber remains constant which keeps the thermal charge pressure in the head chamber constant. When the suction throttling valve closes, the pressure at its outlet is transmitted through passage 60 into the undercut 58 and into the diaphragm chamber 52. This reduced pressure under the diaphragm causes the expansion valve 26 to open to insure sufficient refrigerant flow to maintain the evaporator pressure at 29 to 30 psig under extremely low evaporator loads.

Figure 2:
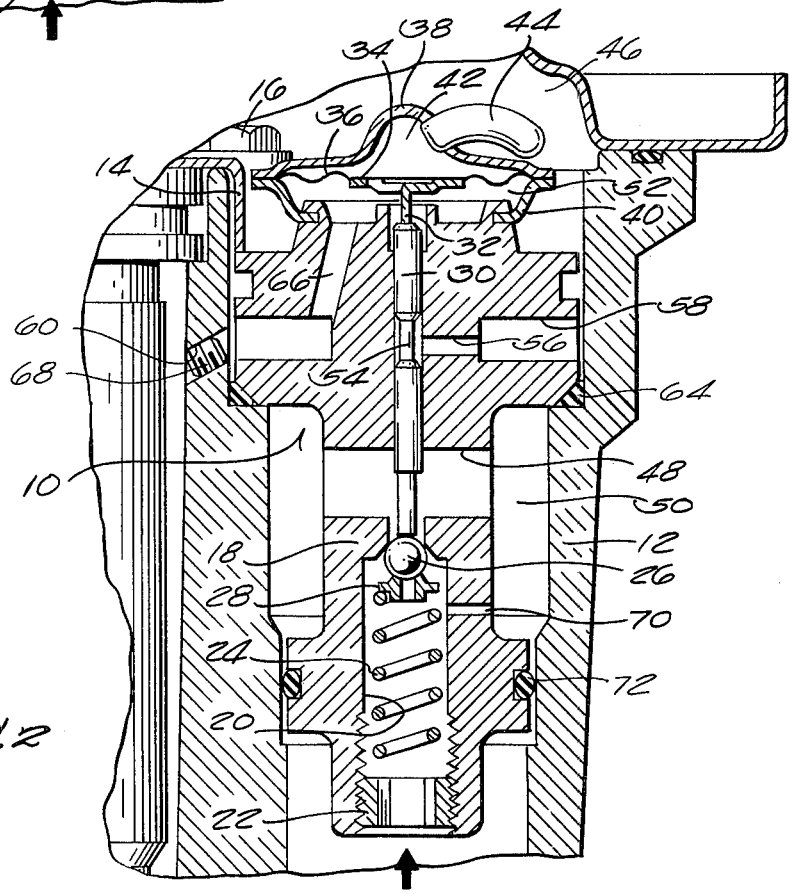
FIG. 2 is comparable to FIG. 1 but illustrates the two-ring version as employed in a conventional air conditioning system.

In the conventional system of FIG. 2 the expansion valve controls superheat at the evaporator outlet. In order to do this the pressure in the diaphragm chamber 52 should be the same as the pressure of the evaporator outlet and omitting the upper O-ring connects the two to equalize these pressures. This, then, permits the thermostatic expansion valve to control superheat in the conventional manner.

I claim:

1. A thermostatic expansion valve comprising, a valve body having an inlet and outlet, a valve for regulating flow from the inlet to the outlet, a head assembly mounted on the body and divided into two chambers by a diaphragm, a temperature responsive charge in the head chamber remote from the body whereby the pressure in the head chamber varies with variation in temperature outside the head chamber to move the diaphragm, a push pin engaged by the diaphragm in the diaphragm chamber opposite the head chamber and slidably mounted in a bore in the body and operatively connected to the valve to actuate the valve, the refrigerant pressure in said diaphragm chamber being lower than the pressure at the valve end of the push pin whereby refrigerant tends to flow along the push pin in the clearance between the pin and the bore, a flow bypass conduit means intercepting the bore and leading to a low pressure space to divert refrigerant flow from the bore away from the diaphragm chamber, said bypass conduit means being connected to the diaphragm chamber, and a reduced diameter section in said pin adjacent said bypass conduit means.

2. A thermostatic expansion valve according to claim 1 in which said body is substantially undercut between the valve portion of the body and the head assembly to reduce heat conduction therebetween.

3. A thermostatic expansion valve according to claim 2 in which said bypass conduit means includes a first conduit between said bore and said undercut and a second conduit between the undercut and the diaphragm chamber.

4. A thermostatic expansion valve according to claim 3 mounted in a cavity, a first O-ring at one end of the body engaging the cavity to prevent flow outside the body from the inlet to the outlet, a second O-ring between the body and the cavity to prevent flow outside the body between the outlet and the head assembly.

5. A thermostatic expansion valve according to claim 4 in which said undercut is between the second O-ring and the head assembly.

6. A thermostatic expansion valve according to claim 5 including a third O-ring between the body and the cavity at a location between the undercut and the head assembly, and a port through the cavity wall from the space between the second and third O-rings.

* * * * *